US007575205B2

(12) United States Patent
Kirchhoff

(10) Patent No.: US 7,575,205 B2
(45) Date of Patent: Aug. 18, 2009

(54) ADJUSTABLE KEYBOARD SUPPORT ASSEMBLY

(75) Inventor: Kenneth J. Kirchhoff, Gem Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 715 days.

(21) Appl. No.: 11/171,948

(22) Filed: Jun. 30, 2005

(65) Prior Publication Data

US 2007/0001077 A1 Jan. 4, 2007

(51) Int. Cl.
*B43L 15/00* (2006.01)

(52) U.S. Cl. ..... 248/118.1; 248/918; 248/286.1; 248/284.1; 108/138; 108/143

(58) Field of Classification Search ..... 248/918, 248/286.1, 118.1, 284.1
See application file for complete search history.

(56) References Cited

U.S. PATENT DOCUMENTS 4,736,689 A 4/1988 Stanko
4,923,259 A 5/1990 Bartok
5,135,197 A * 8/1992 Kelley et al. ..... 248/551
5,294,087 A 3/1994 Drabczyk et al.
5,317,977 A * 6/1994 Omessi ..... 108/97
5,351,897 A * 10/1994 Martin ..... 248/118
5,836,562 A * 11/1998 Danzyger et al. ..... 248/295.11
5,876,002 A * 3/1999 White et al. ..... 248/118
5,901,933 A * 5/1999 Lin ..... 248/285.1
5,924,666 A * 7/1999 Liu ..... 248/286.1
6,027,090 A * 2/2000 Liu ..... 248/281.11
6,079,680 A * 6/2000 Kochanski et al. ..... 248/231.81
6,092,774 A * 7/2000 Choy ..... 248/298.1
6,116,557 A * 9/2000 Choy et al. ..... 248/286.1
6,357,703 B1 * 3/2002 DiOrio ..... 248/118
6,467,737 B1 * 10/2002 Dorantes ..... 248/118

(Continued)

FOREIGN PATENT DOCUMENTS

WO WO 02/24028 A1 3/2002

OTHER PUBLICATIONS

"E-clips combos," ISE, Toronto, Ontario, Canada [on line] [retrieved from the internet on Feb. 23, 2005], URL<http://www.ise-ergonomics.com/products/product-display.cfm?product_id=ecwbhp19mtez>.

(Continued)

*Primary Examiner*—J. Allen Shriver, II
*Assistant Examiner*—Michael McDuffie
(74) *Attorney, Agent, or Firm*—Robert H. Jordan

(57) ABSTRACT

The inventive adjustable keyboard support assembly includes a mounting unit and an adjustable keyboard tray. The mounting unit has an elongated track having opposing first and second ends and opposing top and bottom surfaces; and (b) first means and second means for attaching the mounting unit to the work surface. The first means includes a generally c-shaped clamp having opposing first and second ends, a first substantially horizontal region adjoining a second substantially vertical region, a side flange extending from the second region at the first end of the clamp, and a center flange extending from the second region between the first and second ends of the clamp. The center flange is attached to the first end of the track. The adjustable keyboard tray can be attached to the mounting unit by slidingly engaging it to the bottom surface of the track.

18 Claims, 3 Drawing Sheets

U.S. PATENT DOCUMENTS

| | | | | |
|---|---|---|---|---|
| 6,488,248 | B1 * | 12/2002 | Watt et al. | 248/279.1 |
| 6,527,235 | B1 * | 3/2003 | Cotterill | 248/118.3 |
| 6,536,728 | B1 | 3/2003 | Hagglund et al. | |
| 6,565,055 | B1 * | 5/2003 | Timm | 248/284.1 |
| 7,086,634 | B1 * | 8/2006 | Kirchhoff | 248/286.1 |
| 7,331,556 | B1 * | 2/2008 | Brennan | 248/346.01 |
| 2002/0195533 | A1 * | 12/2002 | Gilberton | 248/316.1 |
| 2004/0262477 | A1 * | 12/2004 | Whitaker et al. | 248/284.1 |
| 2005/0105255 | A1 | 5/2005 | Kirchhoff | |
| 2005/0224671 | A1 * | 10/2005 | Lin | 248/289.11 |

OTHER PUBLICATIONS

"E-Clips," ISE Display Product, Toronto, Ontario, Canada [on line] [updated on the internet on Jun. 30, 2005], URL<http://www.ise-ergonomics.com/products/product-display.cfm?product_id=e_clips>.

* cited by examiner

ADJUSTABLE KEYBOARD SUPPORT ASSEMBLY

FIELD OF INVENTION

The present invention relates to an adjustable keyboard support assembly for use with computing devices. In particular, the present invention provides a support assembly that can be installed to a work surface without the need to use any special tools.

BACKGROUND

Workstations for computers and computer-related equipment typically include at least a computer monitor, a keyboard, and a mousing device. To conserve space and to provide the user with flexibility in positioning the keyboard and mousing device relative to the computer monitor, it is often desirable for the workstation to include a keyboard drawer or keyboard support assembly. The keyboard support assembly typically includes a tray for supporting the keyboard and a mechanical connection that allows movement of the keyboard tray from a storage position to a use or extended position.

Keyboard support assemblies may further include mechanical devices for moving the keyboard from its storage position to a position in front of the user that allows safe and comfortable operation of the keyboard. Because proper positioning of the keyboard may provide ergonomic benefits to the user, various products are available. However, many of the known devices require the use of tools, which may add time and complexity to the installation process. Thus, it is desirable to provide a keyboard support assembly that can be easily installed by the user.

SUMMARY

In one aspect, the present invention relates to an adjustable keyboard assembly that can be secured to the work surface without the need to use any tools. The assembly comprises a mounting unit and an adjustable keyboard tray. The mounting unit comprises (a) an elongated track having opposing first and second ends and opposing top and bottom surfaces; (b) a first means for attaching the mounting unit to the work surface, wherein the first means comprises a generally c-shaped clamp having opposing first and second ends, a first substantially horizontal region adjoining a second substantially vertical region, a flange extending from the second region at the first end of the clamp, and a plate extending from the second region between the first and second ends of the clamp; wherein the plate is attached to the first end of the track; and (c) a second means for attaching the mounting unit to the work surface near the second end of the track. The adjustable keyboard tray can be attached to the mounting unit by slidingly engaging it to the bottom surface of the track. As described further herein, in one embodiment, along the edges and the bottom surface of the track, there are rails that can accommodate ribs on the keyboard tray for assembling the two items.

The present invention provides for several advantages. For example, the keyboard support assembly can be installed without resorting to the use of any special tools because the assembly is self-containing in that fasteners are provided. Furthermore, the inventive assembly is designed with protective devices so as to minimize damage to the work surface.

BRIEF DESCRIPTION OF THE DRAWINGS

The present invention will be further explained with reference to the following figures, wherein.

These figures are not drawn to scale and are intended for illustrative purposes.

DETAILED DESCRIPTION

Figure 1:
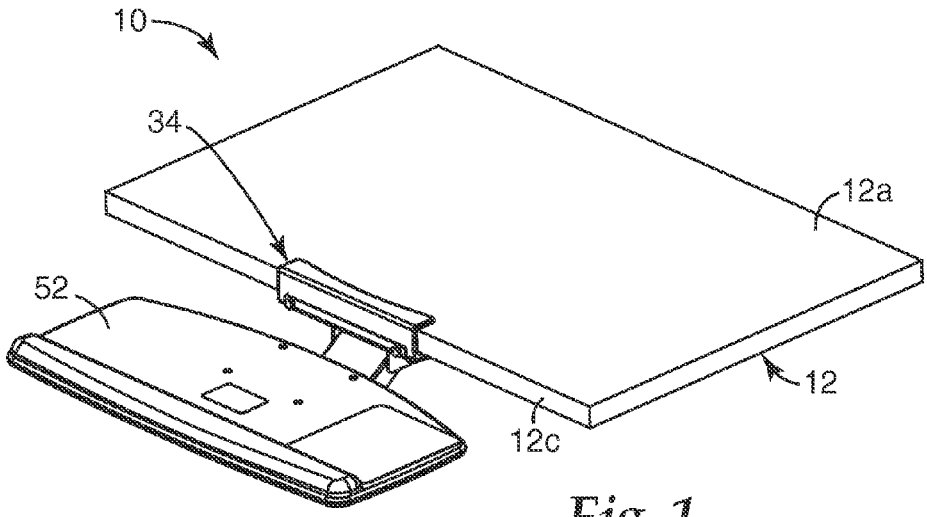
FIG. 1 is a perspective view of one exemplary adjustable keyboard support assembly of the present invention with the keyboard tray in an extended position.
Figure 2:
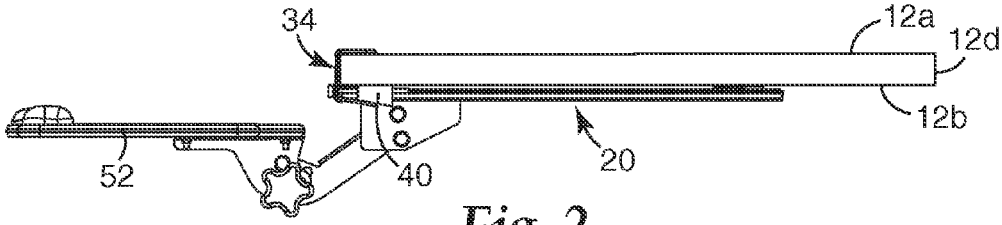
FIG. 2 is a side view of the keyboard support assembly of FIG. 1.

FIGS. 1 and 2 show an exemplary embodiment of the present inventive adjustable keyboard support assembly 10 in an extended, or in a use, position. The keyboard support assembly is installed to a work surface 12, such as a desk. The work surface has opposing top 12*a* and bottom 12*b* surfaces and opposing front and back surfaces, 12*c* and 12*d*. Typically, a computer monitor (not shown) can be positioned on the desk above the keyboard support assembly. The assembly includes mounting unit 20 and adjustable keyboard tray 50.

Figure 3:
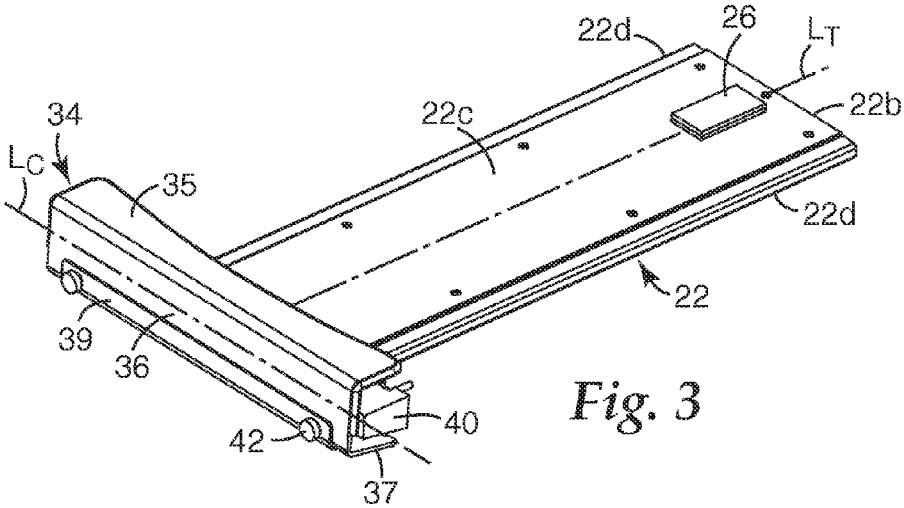
FIG. 3 is a perspective view of an assembled mounting unit.
Figure 4:
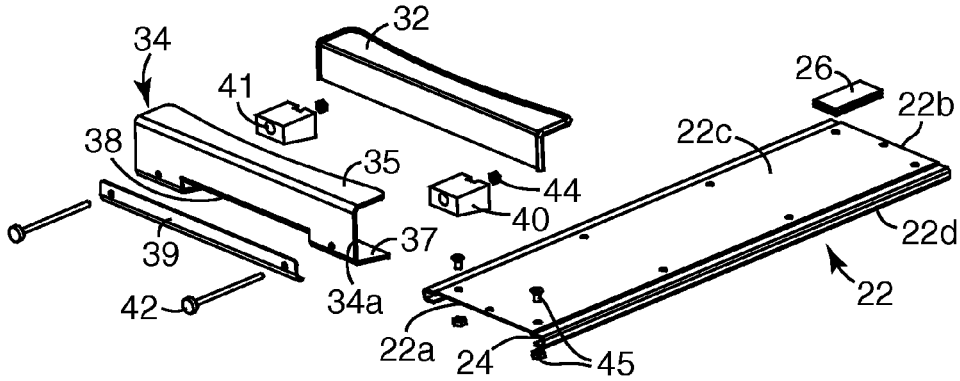
FIG. 4 is an exploded view of an exemplary mounting unit of FIG. 3.

FIGS. 3 and 4 show, respectively, perspective and exploded views of an exemplary mounting unit. The mounting unit includes an elongated track 22 having opposing first and second ends, 22*a* and 22*b*, and opposing top 22*c* and bottom surfaces, and edges 22*d*. Rails 24, which provide a means for engaging with the keyboard tray, lie along the edges and on the bottom side of the track. In one embodiment, the track is fabricated from metal and the rails can be formed by stamping or bending the edges of the track. The track has a longitudinal axis, generally denoted as imaginary line $L_T$. First means and second means are used to attach the mounting unit to the work surface. The first means for attaching the mounting unit to the work surface is disposed at or towards the front of the work surface. The second means for attaching the mounting unit to the work surface is disposed towards the back of the work surface.

Figure 8:
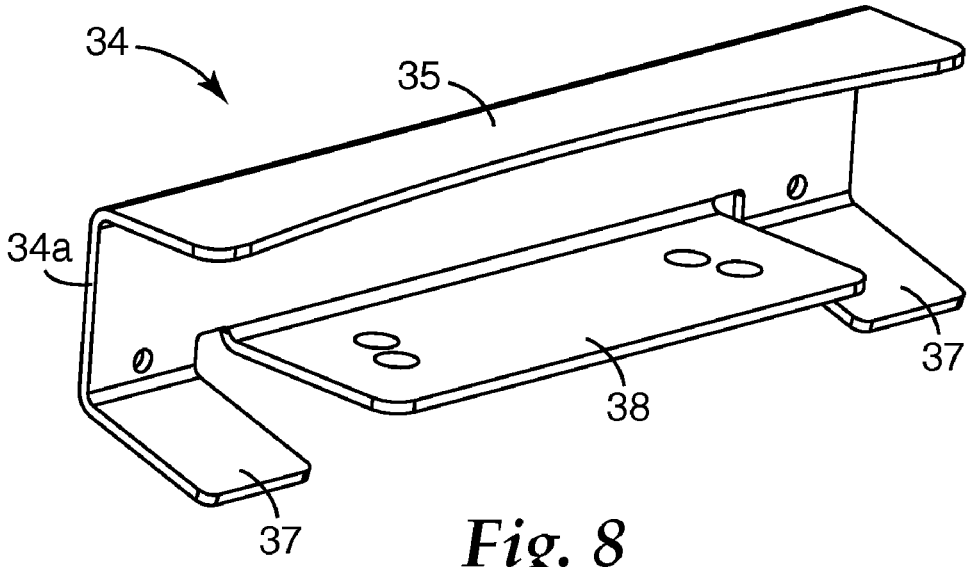
FIG. 8 is a perspective view of the clamp shown in FIG. 1.

As shown in FIGS. 3 and 4, a first means for attaching the mounting unit to work surface 12 includes clamp 34, which is generally c-shaped and thickness adjustment device 40 to adjust for varying thicknesses of work surface upon which the assembly will be installed. The clamp has opposing first and second ends, 34*a* and 34*b*, the distance between which defines the length of the clamp. The clamp also has a longitudinal axis, generally denoted as $L_C$. The clamp has first region 35 that is substantially horizontal and second region 36 adjoining the first region. In this particular embodiment, the second region is substantially vertical. Each of the first and second region has an inside surface, which is that surface that is proximate to the work surface. Extending from the second region at first end 34*a* and second end 34*b* is side flange 37. As shown in FIG. 8, also extending from the second region in between the first and second ends, and specifically in between the side flanges, is center flange 38. The clamp is attached to the first end of the track by using mechanical devices, such as screws, to secure center flange 38 to first end 22*a* of the track. The center flange is substantially horizontal and lies generally parallel to the first region of the clamp. Because the clamp is generally c-shaped, first region 35, side flange 37, and center flange 38 lie in the same direction. The clamp is positioned, relative to the track, such that the longitudinal axis of the clamp, $L_C$, is substantially perpendicular to the longitudinal axis of the track, $L_T$. The side flange is inclined. When the clamp is fabricated from metal, the side and center flanges can be formed by stamping or bending.

In this particular embodiment, the first means for attaching the mounting unit also to the work surface further includes thickness adjustment device 40. The device has opposing top and bottom surfaces, 40*a* and 40*b*, and opposing front and back surfaces, 40*c* and 40*d*. The bottom surface has an incline that is similar to the incline on side flange 37. In one embodiment, the top surface 40*a* is substantially parallel and the front surface, which adjoins the top and bottom surfaces, contains an opening, which is part of bore 41. In the embodiment shown in FIGS. 3 and 4, the bore extends through the thickness adjustment device, although it does not need to do so for the practice of this invention. The thickness adjustment device can be fabricated from a polymeric material such as, e.g., high density polyethylene.

Figure 7:
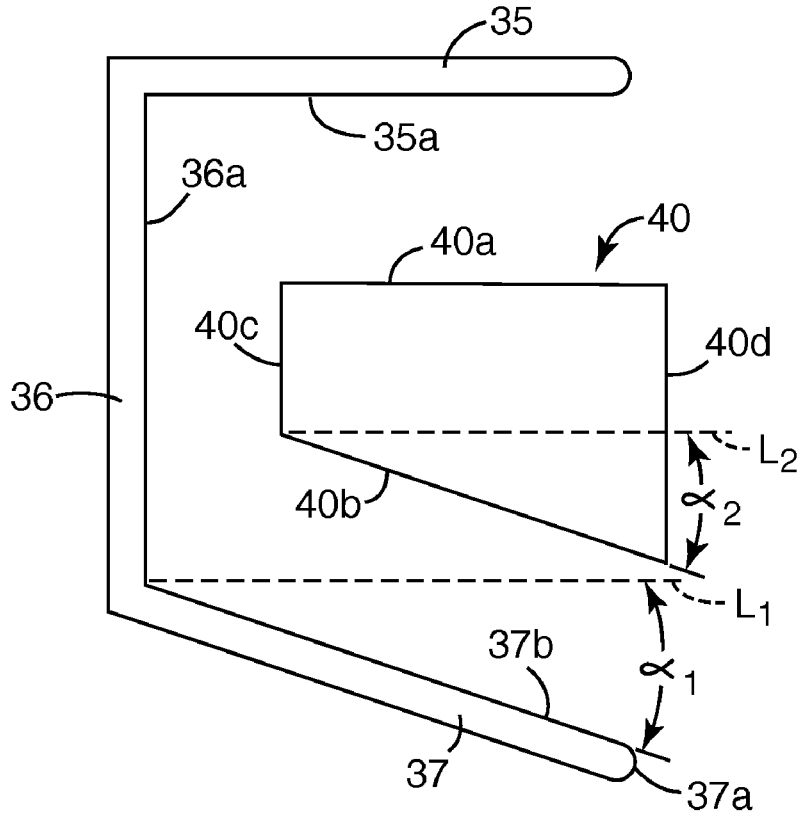
FIG. 7 is a schematic end view of the side flange and the thickness adjustment device.

FIG. 7 shows a schematic side view of a portion of the clamp, at either first 34*a* or second end 34*b*, and thickness adjustment device in order to better describe how side flange 37 cooperates with thickness adjustment device 40 to accommodate for varying thicknesses in work surface 12. As stated, the side flange contains an incline, represented as angle $\alpha_1$, which is the angle formed between the top surface 37*b* of the side flange and an imaginary horizontal line (represented as a horizontal dashed line, $L_1$) that is substantially parallel to first region 35 of the clamp. The thickness adjustment device also includes an incline, represented as angle $\alpha_2$, which is formed between the bottom surface 40*b* of the device and an imaginary horizontal line (represented as a horizontal dashed line, $L_2$) originating at the intersection between front surface 40*c* and bottom surface 40*b* and that is substantially parallel to top surface, 40*a*. The angles, $\alpha_1$, and $\alpha_2$, are similar, if not the same, for the two surfaces, 37*a* and 40*b*, to cooperate with one another. As the thickness adjustment device is moved from exposed end 37*a* of the side flange towards inside surface 36*a* of second region, the distance between inside surface 35*a* of the first region and top surface 40*a* of thickness adjustment means decreases.

The first means for attaching the mounting unit to the work surface may optionally include other components. For example, FIG. 3 shows protective pad 32, which is generally L-shaped, and which is intended to be attached to the inner surfaces of the first and second region of the clamp. In one method, the protective pad is adhesive backed so that it can be attached conveniently to the clamp. The pad is typically a polymeric material that can provide cushion, such as, e.g., urethane foam. The pad protects the work surface from potential damage to the work surface, such as scratches. Another optional component is track guard 39, which functions as a stop and a protection device for the keyboard tray and the keyboard itself. The track guard is typically a polymeric material, such as, e.g., high density polyethylene. FIGS. 3 and 4 also illustrate schematically, second means 26 for attaching mounting unit to work surface near the second end of the track and toward the back of the work surface.

Figure 6:
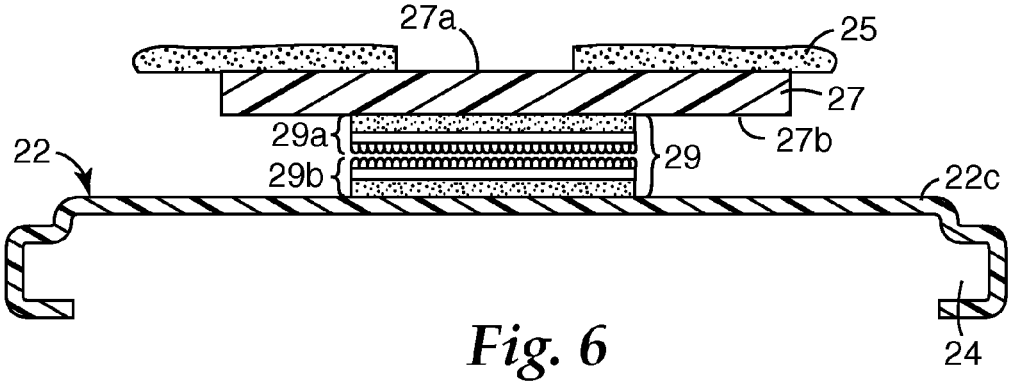
FIG. 6 is an end view of an exemplary mounting unit.

As shown in FIG. 6, in one embodiment, the second means for attaching includes attachment plate 27 having opposing first and second surfaces, 27*a* and 27*b*. The attachment plate can be secured to the track using a variety of means, such as, e.g., mechanical fastener, adhesive, or mechanical devices, such as screws. In the embodiment shown in FIG. 6, hook and loop mechanical fastener 29 is used to secure the attachment plate to the track. First portion 29*a* of the hook and loop fastener is adhesively attached to second surface 27*b* of the attachment plate and second portion 29*b* of the hook and loop fastener is adhesively attached to top surface 22*c* of the track. This particular design allows for convenient assembly and disassembly of the mounting unit by simply unfastening the first hook and loop portion from the second portion. On first surface 27*a* of the attachment plate, there is also double sided adhesive 25 for attaching the attachment plate to the bottom of the work surface. A variety of tape can be used, so long as the tape provides the necessary adhesion between the track and the work surface for the duration of time needed. A suitable tape is commercially available from 3 M Company, St. Paul, Minn. under the COMMAND brand.

In use, the mounting unit can be attached to the work surface using the following exemplary process. The mounting unit is preassembled so that the attachment plate contains the double-sided adhesive (protected with a liner) on the plate's first surface. The first portion of the hook and loop fastener is attached to the plate's second surface. The second portion of the hook and loop fastener is attached to the second end of the track. The attachment plate is then mounted to the track via the two hook and loop portions. The clamp is attached to the first end of the track by securing the center flange to the front end of the track. The pre-assembled mounting unit is then attached to the work surface such that the clamp fits around the front edge of the work surface. During installation, the liner on the double-sided tape is removed and the second end of the track of the pre-assembled mounting unit is attached to the bottom of the work surface. The thickness adjustment device is placed on the side flange and is pushed forward toward the inside of the clamp so as to provide an interference fit between the first region of the clamp and the bottom surface of the work surface. The track guard, if used, is placed on the outside of the second vertical region of the clamp. The track guard and thickness adjustment block can be held together by mechanical devices.

Figure 5:
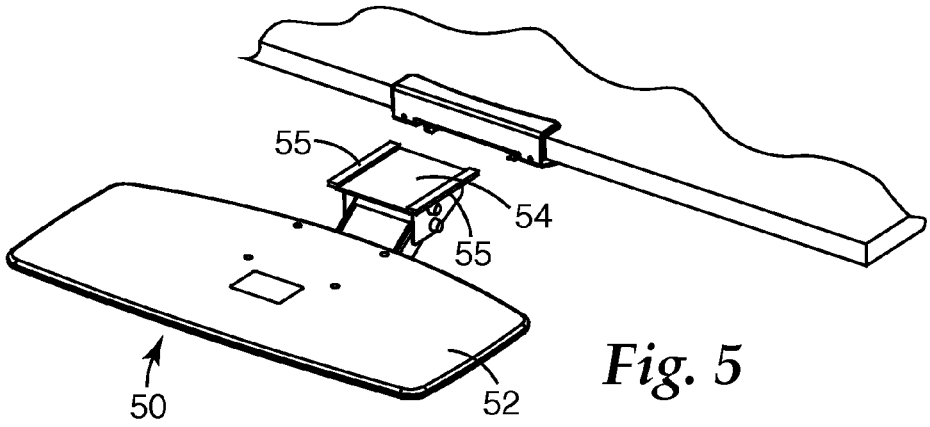
FIG. 5 is a perspective view of an exemplary keyboard tray prior to installation to the work surface having a mounting unit preinstalled.

FIG. 5 shows adjustable keyboard tray 50 includes platform 52 for holding a keyboard (not shown), connecting section 54 having a pair of ribs 55. To complete the installation, ribs 55 are slidingly engaged with rails 24 of track 22.

What is claimed is:

1. An adjustable keyboard assembly securable to a work surface, the assembly comprising:

a mounting unit comprising:

an elongated track having opposing first and second ends and opposing top and bottom surfaces;

a first means for attaching the mounting unit to the work surface, wherein the first means comprises a generally c-shaped clamp having opposing first and second ends, a first substantially horizontal region adjoining a second substantially vertical region, a side flange extending from the second region at the first end of the clamp, a center flange extending from the second region between the first and second ends of the clamp; wherein the center flange is attached to the first end of the track, and a thickness adjustment device disposed on the flange, the thickness adjustment device comprising (a) a top surface for attaching to the work surface, and (b) a bottom inclined surface having an incline that is complimentary to the incline on the flange;

a second means for attaching the mounting unit to the work surface near the second end of the track; and an adjustable keyboard tray slidingly engaged to the bottom surface of the track.

2. The assembly of claim 1, wherein the track has two edges between the first and second end, and wherein the bottom surface of the track comprises a pair of rails running the length of and at the edges of the track.

3. The assembly of claim 2, wherein the adjustable keyboard tray has a platform and an attachment section, the attachment section having a pair of ribs on opposing edges, the ribs slidingly engaged to the rails of the track.

4. The assembly of claim 1, wherein a second side flange extends from the second region at the second end of the clamp.

5. The assembly of claim 4, wherein the side flanges are inclined.

6. The assembly of claim 1, wherein the gap defined by the distance between an inner surface of the horizontal surface and the top surface of the thickness adjustment device is adjustable.

7. The assembly of claim 1, wherein the gap provides interference fit for the work surface.

8. The assembly of claim 1, further comprising a track guard attached to the vertical surface of the c-shaped clamp.

9. The assembly of claim 8, wherein a mechanical means is used to attach the track guard to the vertical surface and to attach the thickness adjustment device to the side flange.

10. The assembly of claim 1, wherein the second means for attaching the track to the work surface comprises (a) an attachment plate having opposing first and second surfaces, (b) an adhesive attachment means disposed on the first surface of the attachment plate, and (c) a mechanical attachment means disposed on the second surface of the attachment plate for mating with complementary mechanical means attached near the second end of the track.

11. The assembly of claim 10, wherein the adhesive attachment means is a double sided tape, the first side applied to the attachment plate, the second side attached to the work surface upon installation of the mounting unit.

12. The assembly of claim 10, wherein the mechanical attachment means is disposed on the second surface of the attachment plate using a pressure sensitive adhesive.

13. The assembly of claim 12, wherein the mechanical attachment means on the attachment plate and the mechanical means on the track is a hook and loop fastener.

14. The assembly of claim 1, wherein the center flange is mechanically attached to the first end of the track.

15. The assembly of claim 1, wherein the track further comprises a guide at the second end and on the bottom side thereof.

16. The assembly of claim 1, wherein the mounting unit further comprises a protection pad attached to an inside surface of the c-shaped clamp.

17. The assembly of claim 16, wherein the protection pad is polymeric.

18. The assembly of claim 1, wherein the track and the clamp each has a longitudinal axis, and the track is positioned relative to the clamp such that the longitudinal axis of the track is substantially perpendicular to the longitudinal axis of the clamp.

* * * * *